US007224352B2

(12) United States Patent
Lifka et al.

(10) Patent No.: US 7,224,352 B2
(45) Date of Patent: May 29, 2007

(54) ACTIVE MATRIX ELECTROLUMINESCENT DISPLAY

(75) Inventors: Herbert Lifka, Son (NL); Mark J. Childs, Sutton (GB); Mark T. Johnson, Veldhoven (NL)

(73) Assignee: Koninklijke Philips Elelctronics N.V., Eindhoven (NL)

( * ) Notice: Subject to any disclaimer, the term of this patent is extended or adjusted under 35 U.S.C. 154(b) by 115 days.

(21) Appl. No.: 10/510,784

(22) PCT Filed: Apr. 1, 2003

(86) PCT No.: PCT/IB03/01338

§ 371 (c)(1),
(2), (4) Date: Oct. 12, 2004

(87) PCT Pub. No.: WO03/088199

PCT Pub. Date: Oct. 23, 2003

(65) Prior Publication Data

US 2005/0151706 A1 Jul. 14, 2005

(30) Foreign Application Priority Data

Apr. 16, 2002 (GB) ..... 0208656.9

(51) Int. Cl.
*G09G 5/00* (2006.01)

(52) U.S. Cl. ..... 345/205; 345/211

(58) Field of Classification Search ..... 345/76–81, 345/36, 204–206, 211–214, 690
See application file for complete search history.

(56) References Cited

U.S. PATENT DOCUMENTS

| | | | |
|---|---|---|---|
| 6,359,605 | B1 | 3/2002 | Knapp et al. |
| 2001/0043172 | A1 | 11/2001 | Troutman |
| 2002/0140642 | A1 | 10/2002 | Okamoto |

FOREIGN PATENT DOCUMENTS

| | | | |
|---|---|---|---|
| EP | 0717446 | A2 | 6/1996 |
| WO | WO 02/17289 | A1 | 2/2002 |

*Primary Examiner*—Amr A. Awad
*Assistant Examiner*—Tom Sheng
(74) *Attorney, Agent, or Firm*—Aaron Waxler; Paul Im

(57) ABSTRACT

An active matrix display includes a display element for producing a visual output when the display element is driven with a constant current, and drive circuitry for controllably driving a substantially constant current through the display element. The drive circuitry includes a two-transistor inverter having an inverter input and a common node output, and the common node output of the inverter is connected, directly or indirectly, to supply or control the current passing through the corresponding display element.

7 Claims, 5 Drawing Sheets

ACTIVE MATRIX ELECTROLUMINESCENT DISPLAY

The invention relates to electroluminescent display devices, for example using organic LED devices such as polymer LEDs.

Matrix display devices employing electroluminescent, light-emitting, display elements are well known. The display elements may comprise organic thin film electroluminescent elements, for example using polymer materials, or else light emitting diodes (LEDs) using traditional III–V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer. The organic material can be fabricated using a CVD process, or simply by a spin coating technique using a solution of a soluble conjugated polymer. Organic electroluminescent materials exhibit diode-like I–V properties, so that they are capable of providing both a display function and a switching function, and can therefore be used in passive type displays. Alternatively, these materials may be used for active matrix display devices, with each pixel comprising a display element and a switching device for controlling the current through the display element.

Organic electroluminescent materials offer advantages in that they are very efficient and require relatively low (DC) drive voltages. Moreover, in contrast to conventional LCDs, no backlight is required.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase. In a similar manner, a digitally addressed display device can be realised by setting the current source transistor to a single (high) current level, or by preventing current flowing by making the current source transistor non-conducting.

In this way, the display elements are integrated into an active matrix, whereby each display element has an associated switching circuit which is operable to supply a drive current to the display element so as to maintain its light output for a significantly longer period than the row address period. Thus, for example, each display element circuit is loaded with an analogue (display data) drive signal once per field period in a respective row address period, which drive signal is stored and is effective to maintain a required drive current through the display element for a field period until the row of display elements concerned is next addressed.

An example of such an active matrix addressed electroluminescent display device is described in EP-A-0717446. The conventional kind of active matrix circuitry used in LCDs cannot be used with electroluminescent display elements as such display elements need to continuously pass current in order to generate light whereas the LC display elements are capacitive and therefore take virtually no current and allow the drive signal voltage to be stored in the capacitance for the whole field period. In EP-A-0717446, each switching circuit comprises two TFTs (thin film transistors) and a storage capacitor. The anode of the display element is connected to the drain of the second TFT and the first TFT is connected to the gate of the second TFT which is connected also to one side of the capacitor. During a row address period, the first TFT is turned on by means of a row selection (gating) signal and a drive (data) signal is transferred via this TFT to the capacitor. The data signal may be either analogue or digital in nature.

After the removal of the selection signal the first TFT turns off and the voltage stored on the capacitor, constituting a gate voltage for the second TFT, is responsible for operation of the second TFT which is arranged to deliver electrical current to the display element. The gate of the first TFT is connected to a gate line (row conductor) common to all display elements in the same row and the source of the first TFT is connected to a source line (column conductor) common to all display elements in the same column. The drain and source electrodes of the second TFT are connected to the anode of the display element and a ground line which extends parallel to the source line and is common to all display elements in the same column. The other side of the capacitor is also connected to this ground line.

The active matrix structure is fabricated on a suitable transparent, insulating, support, for example of glass, using thin film deposition and process technology similar to that used in the manufacture of AMLCDs.

With this arrangement, the drive current for the light-emitting diode display element is determined by a voltage applied to the gate of the second TFT. This current therefore depends strongly on the characteristics of that TFT. Variations in threshold voltage, mobility and dimensions of the TFT will produce unwanted variations in the display element current, and hence its light output. Such variations in the second TFTs associated with display elements over the area of the array, or between different arrays, due, for example, to manufacturing processes, lead to non-uniformity of light outputs from the display elements.

In order to address this issue, digital driving options have been proposed, whereby the pixel is operated by either setting the brightness to a maximum value for a given drive voltage (digital "on") or by preventing current flow (digital "off"). Grey levels are typically generated by using either time-ratio or area-ratio methods known from the prior art.

However, the known digital pixel circuits still require storage capacitors which act as the memory element that stores a voltage. Due to leakage in the pixel the stored voltage value tends to drift and this can detract from the performance of the circuit.

Further, the capacitors tend to be large and reduce the aperture of the pixel.

In addition, the gate voltage stored as a result of the current sampling operation can be subject to variation as a result of TFT parasitic capacitances. This effect is known as "kick back".

A further issue with the prior art pixels is that it takes a long time to charge the storage capacitors, preventing rapid addressing of the pixels. This makes it difficult to successfully apply the time-ratio grey scale approach, as short addressing times are difficult to realise.

Thus, there remains a need for an improved display device addressing some or all of these issues.

According to a first aspect of the invention there is provided an active matrix display, including a display element for producing a visual output when the display element is driven with a constant current; and drive circuitry for controllably driving a substantially constant current through the display element, the drive circuitry including a two transistor inverter having an inverter input and a common node output, wherein the common node output of the inverter is connected, directly or indirectly, to supply or control the current passing through the corresponding display element.

By providing an inverter having a pair of transistors, the voltage on the common node output is held by one of the transistors in each state; the common node is not free to oscillate in voltage. This greatly reduces kick back.

The display element may conveniently be an organic light emitting diode.

The display may include a plurality of data lines for carrying a digital signal; a plurality of address lines; and the drive circuitry of each pixel may include an input node and an address transistor for inputting a digital signal to the input node, the address transistor being connected to one of the address lines, one of the data lines, and the input node. Thus, the display may be addressed digitally.

According to another aspect of the invention, there is provided an active matrix display, comprising an array of pixels arranged in rows and columns, wherein each pixel includes: an organic light emitting diode display element connected to a drive node; an address transistor connected between a data line and an input node, the address transistor having a control terminal connected to an address line; a drive transistor connected between a first power line and the drive node to drive the organic light emitting diode, the drive transistor being controlled for inverting operation by the input node; and a feedback inverter having its input connected to the drive node and its output connected to the input node.

The drive circuitry thus functions as a memory that retains data without the need for refreshing. Thus, there is no need for a refresh cycle until the data is changed. This can save power.

The feedback loop ensures stability and, as it provides a memory function, allows storage capacitors to be omitted. This may allow a reduction in the circuit area required for the circuitry in each pixel. The display may further comprise a discharge transistor of opposite conductivity type to the drive transistor connected between the drive node and a second power line, the discharge capacitor and the drive transistor forming an inverter. In such an arrangement, the kick-back is virtually zero.

The feedback inverter is conveniently formed by a charge transistor connected between the first power line and a common node, and a discharge transistor of opposite conductivity type to the charge transistor connected between the common node and a second power line.

A single common line preferably constitutes a power line of one row and the address line of an adjacent row. This sharing of one line to have two functions increases the aperture of the display and eases manufacture by reducing the number of row lines required across the display.

The address transistor may be a p-type transistor, and the common line may be the high power line of one row and the address line of an adjacent row. Alternatively, the address transistor may be an n-type transistor, and common line may be the low power line of one row and the address line of an adjacent row.

In another aspect, the invention proposes an active matrix display, comprising an array of pixels arranged in rows and columns, wherein each pixel includes: an organic light emitting diode display element connected to a drive node; an address transistor connected between a data line and an input node, the address transistor having a control terminal connected to an address line; a drive transistor connected between a first power line and the drive node to drive the organic light emitting diode; and a discharge transistor of opposite conductivity type to the drive transistor connected between the drive node and a second power line, the discharge capacitor and the drive transistor forming an inverter controlled by the input node.

In a further aspect, the invention includes a method of driving an active matrix display including a plurality of pixels each with drive circuitry including a drive transistor and an inverter and a display element, the method including the steps of: addressing the pixels in turn; supplying digital data to the addressed pixels; controlling a drive transistor in inverting operation with the signal on the input node to drive a controllable constant current through the display element; and feeding back the voltage driving the display element through an inverter to the input node.

Embodiments of the invention will now be described, purely by way of example, with reference to the accompanying drawings, in which:

The same reference numbers are used throughout the figures to denote the same or similar parts.

FIG. 1 shows a single pixel element 2 of a polymer light emitting diode array according to the invention.

Figure 1:
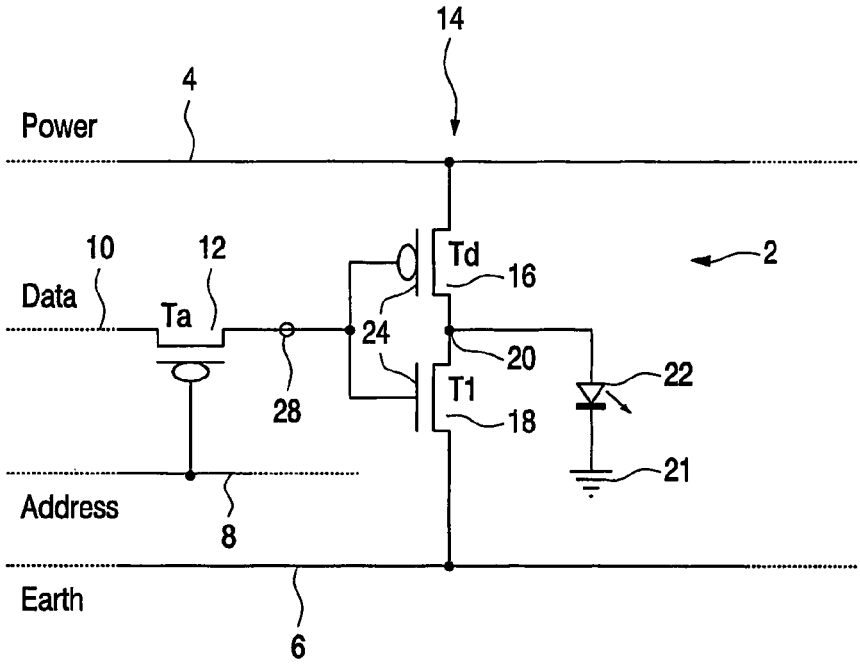
FIG. 1 shows a circuit diagram of a single pixel of a first embodiment of the invention.

The pixel element is supplied by power line 4 and earth line 6. Address line 8 and data line 10 also feed into the pixel.

Drive circuitry includes address thin-film transistor (TFT) 12 which acts as an addressing element which when switched on allows data to be placed on the pixel from data line 10. In the illustrated embodiment, address TFT 12 is a p-type transistor, but the skilled person will appreciate that n-type transistors can be used also.

A two-transistor inverter 14 is constituted by two TFTs, a charge TFT 16 and a discharge TFT 18 connected in series between the power line 4 and the earth line 6. The charge TFT 16 is a p-type TFT connected between positive power line 4 and drive node 20, and the discharge TFT 18 is an n-type TFT between the drive node 20 and the earth line 6. The gates 24 of TFTs 16 and 18 are connected in common to input node 28 which is connected to the output of addressing TFT 12.

A polymer light emitting diode (PLED) 22 display element is connected between drive node 20 and earth 21.

In use, the drive circuitry switches between an "on" and an "off" mode. In the "on" mode, PLED 22 is driven with a constant current by the drive circuitry to switch the PLED on and emit light.

In more detail, address line 8 is pulled low to switch on addressing TFT 12 and allow the signal on the data line 10 to be passed through to input 28 of the inverter 14. When the input 28 is high, discharge TFT 18 is switched on pulling node 20 low and so switching off the PLED 22. Conversely, when input 28 is low discharge TFT 18 is switched off and charge TFT 16 switched on to pull node 20 high and drive LED 22.

The data signal is stored on the parasitic capacitance of the gates 24 of the inverter TFTs 16,18 even after the address line 8 goes high. The parasitic capacitance is great enough to retain the state of the inverter until the pixel is addressed again.

The area required for the pixel drive inverter is much less than is conventionally needed for a capacitor.

Figure 2:
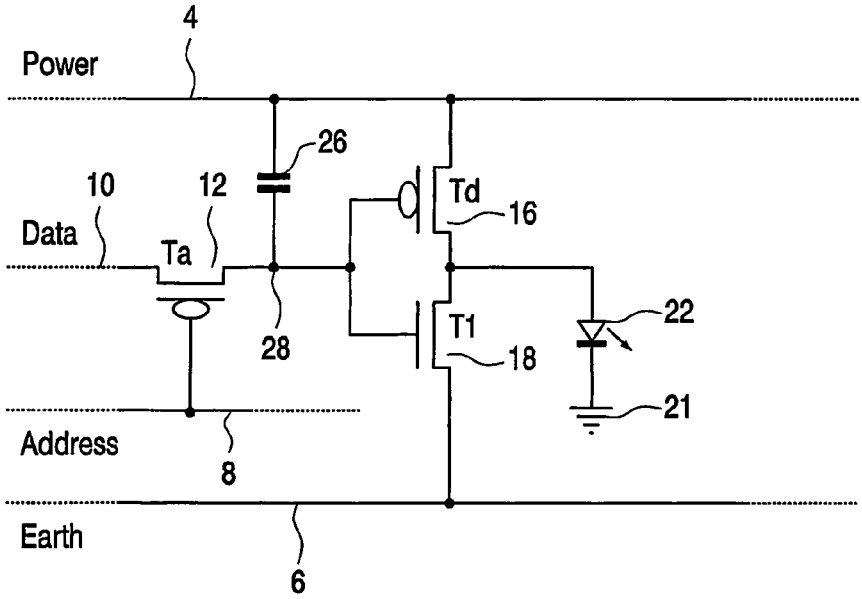
FIG. 2 shows a circuit diagram of a single pixel of a second embodiment of the invention.

FIG. 2 illustrates a second embodiment that differs from the arrangement shown in FIG. 1 in that a storage capacitor 26 is provided between the input node 28 of the address TFT 12 and the power line 4. In this arrangement, the storage capacitor 26 can be much smaller than in prior arrangements in which a storage capacitor alone has to drive a a single transistor driving the LED.

Figure 3:
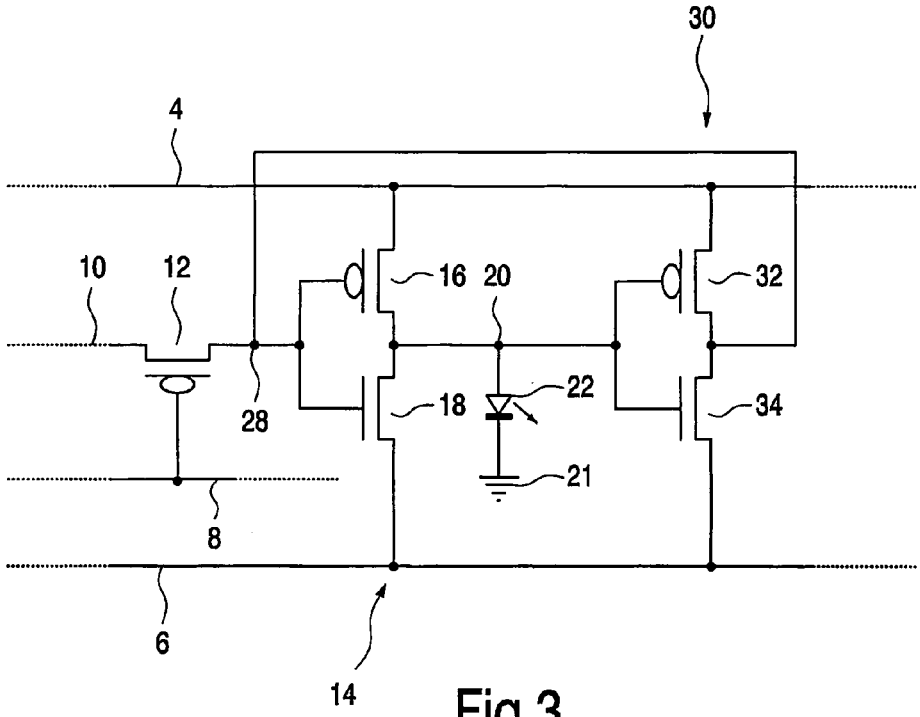
FIG. 3 shows a circuit diagram of a single pixel of a third embodiment of the invention.

FIG. 3 illustrates a further embodiment of the basic design which adds a second two-transistor feedback inverter 30 having a charge TFT 32 and a discharge TFT 34. The input of the second inverter is connected to drive node 20 and the output to node 28, the input to the first inverter 14. Thus, the second inverter 30 acts as a feedback device.

In use, the two inverters 14,30 hold the state of the pixel actively, so that the pixel will remain in its state indefinitely. There is virtually no kick back in this configuration.

The pixel stability is enhanced over prior approaches that simply use a capacitance to store data.

The drive circuitry is very fast, principally because there is no large capacitance to charge. Thus, the drive circuitry is highly suitable for driving the cell at different on/off time ratios to deliver different grey values, especially low grey values. In these drive schemes, the power required to drive the pixel may be reduced.

Figure 4:
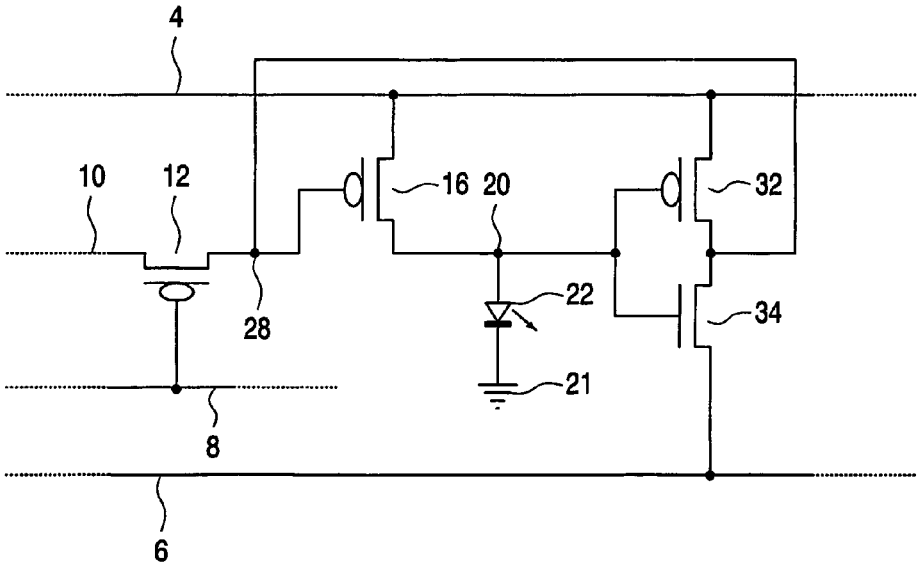
FIG. 4 shows a circuit diagram of a single pixel of a fourth embodiment of the invention.

FIG. 4 illustrates a further variation, similar to that of FIG. 3 except that first discharge transistor 18 is omitted. The result is that the first stage no longer has a discharge TFT 18 for fully switching off PLED 22. In the arrangement of FIG. 4 this effect is achieved by discharge transistor 34. The discharge TFT 34 of the feedback inverter 30 pulls down the input node 28 switching off the drive TFT 16 hard.

Figure 5:
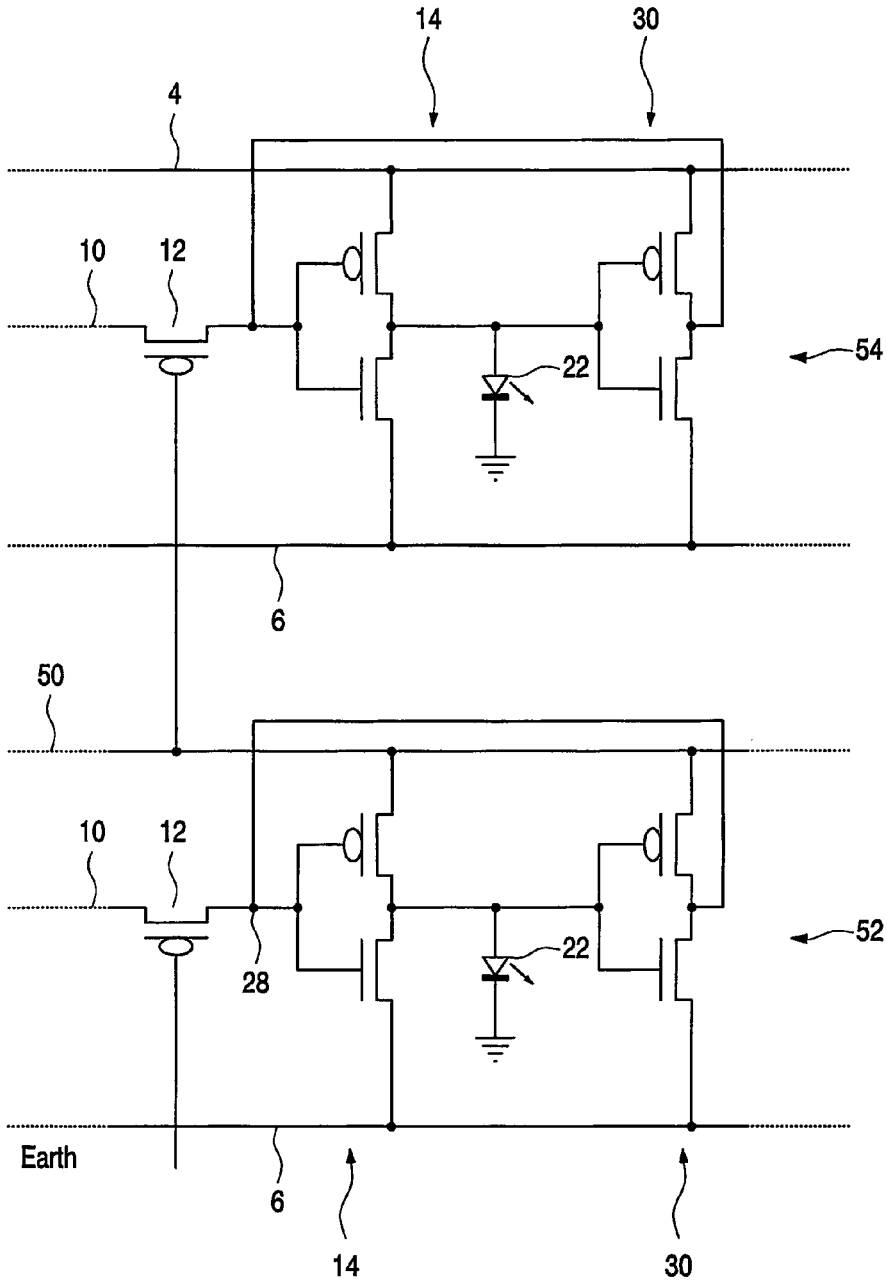
FIG. 5 shows a circuit diagram of a fifth embodiment of the invention.
Figure 6:
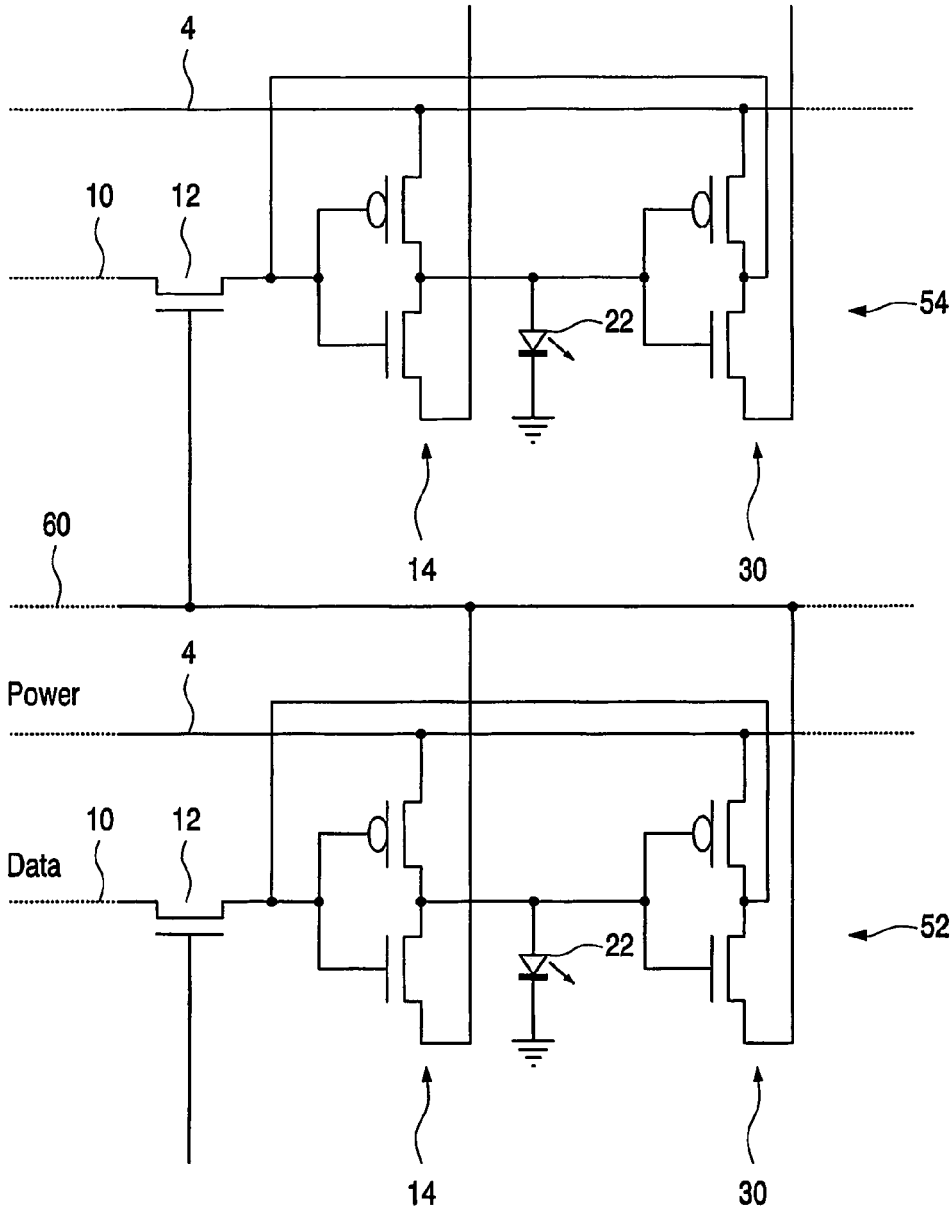
FIG. 6 shows a circuit diagram of a sixth embodiment of the invention.

It will be noted that a feature of all of the above embodiments is the need to provide a separate power and earth line to each pixel because the PLED ground 21 is not available to act as the low power supply for the inverter or inverters. FIGS. 5 and 6 illustrate fifth and sixth embodiments of the invention in which the address line is shared with an inverter power line of an adjacent row, therefore reducing the number of row lines by one.

In FIG. 5, common line 50 is connected as the high power supply 4 for inverters 14,30 of row 52. The common line is also connected to the gate of p-type address TFTs 12 of the preceding row 54.

In use, common line 50 acts as the power line for one row 52 of pixels and the address line for the preceding row 54. Thus, common line 50 acts as the power line powering inverters 14,30 of row 52 when it is high, but when it is low it switches on TFT 12 of the preceding row 54 to select that row. Since adjacent rows are not selected at the same time, there is no conflict between the dual roles of common line 50.

FIG. 6 illustrates a similar arrangement in a n-type addressing scheme. In this case, common line 60 is connected as the low power supply 6 for inverters 14,30 of row 52. The common line is also connected to the gate of n-type address TFT 12 of the preceding row 54.

In use, common line 60 acts as the low power line for one row 52 of pixels and the address line for the preceding row 54. Thus, common line 50 acts as the low power line powering inverters 14,30 of row 52 when it is low, but when it is high it switches on TFT 12 of the preceding row 54 to select that row.

Figure 7:
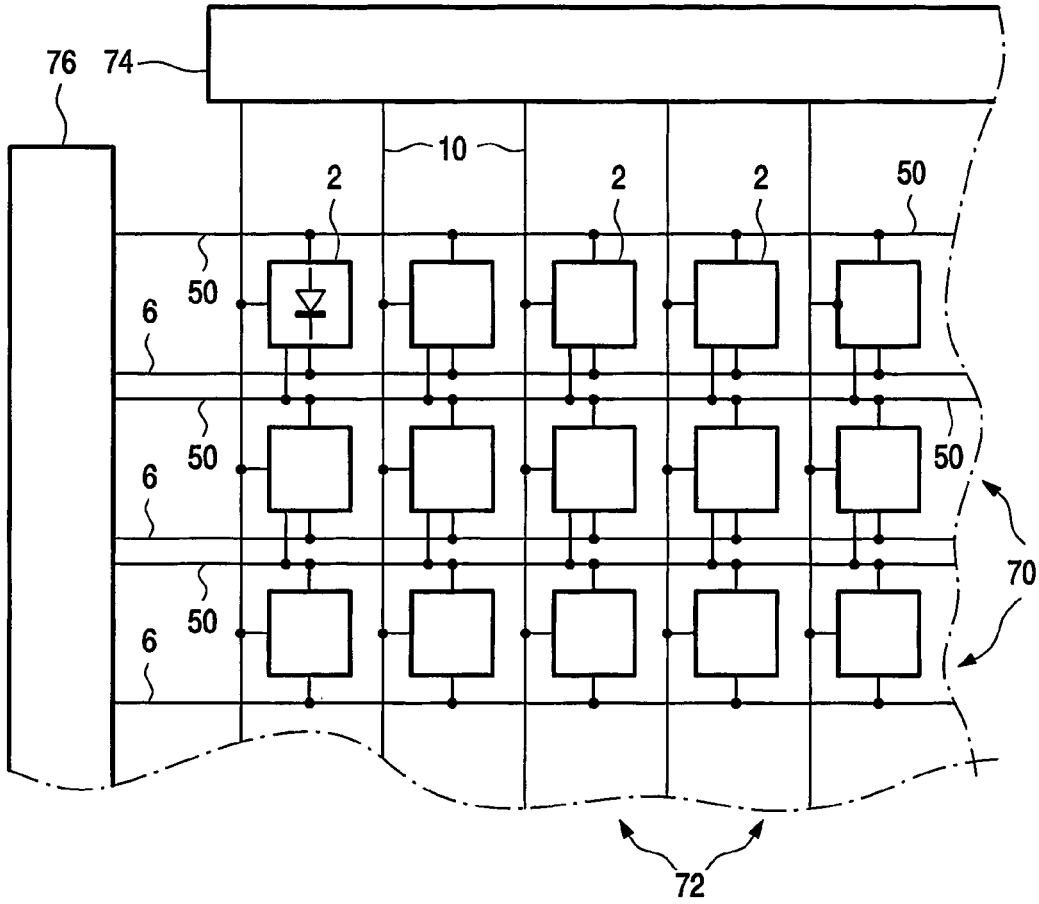
FIG. 7 shows a schematic diagram of a complete display.

As illustrated in FIG. 7, a plurality of pixels 2 are arranged in a plurality of rows 70 and columns 72 to form a complete active matrix electroluminescent display. Data lines 10 run in the column direction.

The example of FIG. 7 illustrates the arrangement of a complete electroluminescent display according to the embodiment of FIG. 5, in which common power and address lines 50, and low power lines 6 run in the row direction. Column driver 74 drives the data lines 10, and row driver 76 drives the address lines 50,6. It will readily be appreciated that similar complete displays may be made using the arrangements of embodiments 1 to 4 by providing separate high and low power lines 4, 6 and address lines 8 running in the row direction.

From reading the present disclosure, other variations and modifications will be apparent to persons skilled in the art. Such variations and modifications may involve equivalent and other features which are already known in the design, manufacture and use of displays and which may be used in addition to or instead of features described herein.

For example, the polymer light emitting diode may be replaced by an alternative organic light emitting diode, as will be well known to those skilled in the art. In addition, other active matrix displays which work on the principle of a pixel circuit supplying a substantially constant current during the operation period can be beneficially driven using drive circuitry according to the invention. Examples of such display principles are field emission displays, electrochromic displays, switching mirror displays, displays with local pixel oscillators etc.

The invention claimed is:

1. An active matrix display, comprising an array of pixels (2) arranged in rows and columns, wherein each pixel includes:

a display element (22) for producing a visual output when the display element is driven with a constant current;

drive circuitry for controllably driving a substantially constant current through the display element, the drive circuitry including a two transistor inverter (14, 30) having an input node (28) and a drive node (20), wherein the common node output of the inverter is connected, directly or indirectly, to supply or control the current passing through the corresponding display element;

wherein the active matrix display further comprises a plurality of data lines (10) for carrying a digital signal, a plurality of address lines (8);

wherein the drive circuitry of each pixel comprises an input mode (28) and an address transistor (12) for inputting a digital signal to the input node, the address transistor being connected to one of the address lines (8), one of the data lines (10), and the input node (28); and wherein a single common line (50,60) constitutes a power line of one row and the address line of an adjacent row.

2. An active matrix display according to claim 1 wherein the display element (22) is an organic light emitting diode.

3. An active matrix display according to claim 1, wherein:

the drive circuitry includes a drive transistor (16) connected between a first power (4) line and a drive node (20) to drive the display element (22), the drive transistor being controlled for inverting operation by the input node (28); and the inverter (30) is a feedback inverter having its input connected to the drive node and its common node output connected to the input node.

4. An active matrix display according to claim 3 further comprising a discharge transistor (18) of opposite conductivity type to the drive transistor (16) connected between the drive node (20) and a second power line (6), the discharge transistor and the drive transistor (16) forming an inverter (14).

5. A active matrix display according to claim 1, wherein the common node (20) is connected to drive the display element and the input of the inverter is connected to the input node.

6. An active matrix display according to claim 1 wherein the address transistor is a p-type transistor (12), and the common line (50) is the high power line of one row and the address line of an adjacent row.

7. An active matrix display according to claim 1 wherein the address transistor (12) is an n-type transistor, and the common line (60) is the low power line of one row and the address line of an adjacent row.

* * * * *